US008279718B2

(12) United States Patent
Hirano

(10) Patent No.: US 8,279,718 B2
(45) Date of Patent: Oct. 2, 2012

(54) CALENDAR MECHANISM AND ANALOG TIMEPIECE EQUIPPED WITH SAME MECHANISM

(75) Inventor: Kei Hirano, Chiba (JP)

(73) Assignee: Seiko Instruments Inc. (JP)

( * ) Notice: Subject to any disclaimer, the term of this patent is extended or adjusted under 35 U.S.C. 154(b) by 153 days.

(21) Appl. No.: 12/925,376

(22) Filed: Oct. 20, 2010

(65) Prior Publication Data

US 2011/0090767 A1 Apr. 21, 2011

(30) Foreign Application Priority Data

Oct. 21, 2009 (JP) ..... 2009-242718

(51) Int. Cl.
*G04B 19/24* (2006.01)

(52) U.S. Cl. ..... 368/37

(58) Field of Classification Search ..... 368/28, 368/35, 37

See application file for complete search history.

(56) References Cited

U.S. PATENT DOCUMENTS 4,257,113 A * 3/1981 Meister et al. ..... 368/35
6,081,483 A * 6/2000 Capt et al. ..... 368/28
6,958,952 B2 * 10/2005 Gabathuler et al. ..... 368/28
7,023,762 B1 * 4/2006 Burkhardt et al. ..... 368/35
7,180,829 B2 * 2/2007 Watanabe ..... 368/37
7,724,611 B2 * 5/2010 Groothuis et al. ..... 368/37
2007/0201312 A1 8/2007 Watanabe ..... 368/37

* cited by examiner

*Primary Examiner* — Vit W Miska
(74) *Attorney, Agent, or Firm* — Adams & Wilks

(57) ABSTRACT

To provide a calendar mechanism wherein the building-in property of a second date indicator is improved, and an analog timepiece equipped therewith. A calendar mechanism of an analog timepiece includes a first date indicator which includes a first date character indication portion, a first date indicator gear portion, and an endless ring-shaped drive cam portion; a drive cam lever which includes an operating lever portion including a first fan-shaped gear portion, wherein a driven lever portion is spring loaded in order to become a cam follower, and the operating lever portion is pivoted in accordance with the driven lever portion abutting against the drive cam portion; a second date indicator which, being rotatable, includes a second date character indication portion and a second fan-shaped gear portion meshing with the first fan-shaped gear portion; and a positioning/locking portion. In a case in which the tens column of the date is 0, one portion of the drive cam lever abuts against the positioning/locking portion, causing the cam follower of the driven lever portion to remain in a condition out of contact with an invalid cam face portion of the cam face of the drive cam portion.

20 Claims, 6 Drawing Sheets

FIGI. 4

CALENDAR MECHANISM AND ANALOG TIMEPIECE EQUIPPED WITH SAME MECHANISM

BACKGROUND OF THE INVENTION

1. Field of the Invention

The present invention relates to a calendar mechanism and an analog timepiece equipped therewith, and more particularly relates to a calendar mechanism of a so-called big date form wherein the ones column and tens column of the date are indicated with separate date indicators, as a result of which it is possible to indicate the date in large characters, and to an analog timepiece equipped with the calendar mechanism.

2. Description of the Related Art

As a calendar mechanism of a big date form, a calendar mechanism is proposed which includes a first date indicator including a first date character indication portion which, being circular as a whole, indicates the ones column of the date, a circular first date indicator gear portion which, being formed on the inner periphery of the first date character indication portion, receives a torque, and a drive cam portion which, being formed on the back side of a first date character indication surface portion, defines an endless ring-shaped cam face; a drive cam lever including a driven lever portion whose one end portion abuts against the drive cam portion as a cam follower, and an operating lever portion which, being integral with the driven lever portion, includes a first fan-shaped gear portion at the leading end portion, wherein the one end portion of the driven lever portion is spring loaded in such a way as to be biased toward the cam face of the drive cam portion, and when the driven lever portion is pivoted in a condition in which the one end portion is in abutment with the cam face of the drive cam portion, the first fan-shaped gear portion of the operating lever portion is pivoted in accordance with the pivoting of the driven lever portion; and a second date indicator including a second date character indication portion which indicates the tens column of the date, and a second fan-shaped gear portion meshing with the first fan-shaped gear portion (for example, JP-A-2007-218856). With the calendar mechanism proposed in JP-A-2007-218856, the drive cam portion includes a first cam face portion corresponding to a case in which the tens column of the date is 0, in addition to a second and third cam face portion corresponding to a case in which the tens column of the date is 1 and 2, and a fourth cam face portion corresponding to a case in which the tens column of the date is 3.

Consequently, with this kind of heretofore known calendar mechanism, the drive cam lever is constantly subjected to a pivotal bias force in a direction in which the one end portion of the driven lever portion forming the cam follower is pressed against the cam face of the drive cam portion by a spring.

As a result of this, with the calendar mechanism proposed in JP-A-2007-218856, when the first date indicator is built in, it is necessary that the drive cam lever including the driven lever portion is shifted in order that the operating lever portion of the spring loaded drive cam lever does not abut against the drive cam portion of the first date indicator, and it is difficult to avoid taking a lot of trouble over the building in.

SUMMARY OF THE INVENTION

It is an aspect of the invention to provide a calendar mechanism wherein a building in of a first date indicator can be easily carried out, and an analog timepiece equipped with the calendar mechanism.

A calendar mechanism of the invention, in order to achieve the heretofore described object, includes a first date indicator which, being rotatable around a first central axis of rotation, includes a first date character indication portion which, being circular as a whole, indicates the ones column of the date, a circular first date indicator gear portion which, being formed on the inner periphery of the first date character indication portion, receives a torque, and a drive cam portion which, being formed on the back side of a first date character indication surface portion, defines an endless ring-shaped cam face; a drive cam lever which includes a driven lever portion whose one end portion abuts against the drive cam portion as a cam follower, and an operating lever portion which, being integral with the driven lever portion, includes a first fan-shaped gear portion at the leading end portion, wherein the one end portion of the driven lever portion is spring loaded in such a way as to be biased toward the cam face of the drive cam portion, and when the driven lever portion is pivoted in a condition in which the one end portion is in abutment with the cam face of the drive cam portion, the first fan-shaped gear portion of the operating lever portion is pivoted in accordance with the pivoting of the driven lever portion; a second date indicator which, being rotatable around a second central axis of rotation, includes a second date character indication portion which indicates the tens column of the date, and a second fan-shaped gear portion meshing with the first fan-shaped gear portion; and a stationary support including a positioning/locking portion, wherein the cam face of the drive cam portion, as well as including a second and third cam face portion corresponding to a case in which the tens column of the date is 1 and 2, and including a fourth cam face portion corresponding to a case in which the tens column of the date is one of 0 or 3, includes an invalid cam face portion corresponding to a case in which the tens column of the date is the other of 0 or 3, wherein the calendar mechanism is configured in such a way that in the case in which the tens column of the date is the other of 0 or 3, one portion of the drive cam lever abuts against the positioning/locking portion, causing the cam follower of the driven lever portion to come near to and face the invalid cam face portion of the cam face of the drive cam portion, but to remain in a condition out of contact with the invalid cam face portion.

With the calendar mechanism of the invention, as "a stationary support includes a positioning/locking portion, and the cam face of the drive cam portion, as well as including a fourth cam face portion corresponding to a case in which the tens column of the date is one of 0 or 3, includes an invalid cam face portion corresponding to a case in which the tens column of the date is the other of 0 or 3, wherein the calendar mechanism is configured in such a way that in the case in which the tens column of the date is the other of 0 or 3, one portion of the drive cam lever abuts against the positioning/locking portion, causing the cam follower of the driven lever portion to come near to and face the invalid cam face portion of the cam face of the drive cam portion, but to remain in a condition out of contact with the invalid cam face portion", in an initial building-in condition in which the one portion of the drive cam lever is brought into abutment with the positioning/locking portion, the invalid cam face portion of the cam face of the first date indicator does not abut against the drive cam lever, meaning that when an arrangement is adopted such that the first date indicator is built in a predetermined rotational position (a kind of rotational position in which the cam follower of the driven lever portion of the drive cam lever faces the invalid cam face portion of the cam face of the first date indicator, in the out-of-contact condition) with the drive cam lever remaining placed in the initial building-in condition, it is possible, without taking into account an engagement with the drive cam lever, to build in the first date indicator simply by mounting the first date indicator in the predetermined rotational position (rotational range), in actuality in the condition out of contact with the drive cam lever, that is, without shifting the drive cam lever. Consequently, as the building in of the first date indicator does not take a lot of trouble, the building-in property of the first date indicator is improved, and a building in of the calendar mechanism can be easily carried out.

Also, in the above, the driven lever portion of the drive cam lever and the first fan-shaped gear portion are typically integral. However, when desired, the two do not have to be integral.

With the calendar mechanism of the invention, typically, the invalid cam face portion is a portion of the cam face corresponding to a case in which the tens column of the date is 0, and the fourth cam face portion is a portion of the cam face corresponding to a case in which the tens column of the date is 3.

In this case, by adopting an arrangement such that the first date indicator is built in a rotational position of the first date indicator in which the tens column of the date coming to a date window is 0, and the cam follower of the driven lever portion of the drive cam lever faces the invalid cam face portion of the first date indicator in the out-of-contact condition, the building in of the first date indicator can be easily carried out. Then, in this case, in the case in which the tens column of the date is 0, the drive cam lever is locked by any portion thereof abutting against the positioning/locking portion, and the pivotal position of the drive cam lever is defined by the positioning/locking portion. Meanwhile, in the case in which the tens column of the date is 1, 2, or 3, in the same way as heretofore known, the driven lever portion of the drive cam lever abuts against the second cam face portion, third cam face portion, and fourth cam face portion respectively, thus defining the pivotal position of the drive cam lever.

However, for example, the invalid face portion may be a cam face portion corresponding to a case in which the tens column of the date is 3 in place of 0. In this case, by building in the first date indicator in a corresponding rotational position of the first date indicator, the building in of the first date indicator can be easily carried out. In this case, the cam face portions forming the drive cam portion may be formed on the inner peripheral surface, in place of the outer peripheral surface, of the wall portion of the first date indicator.

With the calendar mechanism of the invention, typically, the positioning/locking portion is formed of a reference position determination projection formed on the stationary support.

In this case, simply by bringing one portion of the drive cam lever into abutment with the reference position determination projection formed on the stationary support, the spring loaded drive cam lever can be supported by the projection. Consequently, even without shifting the position of the drive cam lever, the first date indicator can be built in without bringing the drive cam portion of the first date indicator into contact with the drive cam lever.

That is, with the calendar mechanism of the invention, typically, the stationary support is formed of a main plate or a bridge. Herein, the bridge can include various kinds of bridge (a train wheel bridge, a barrel and train wheel bridge, a third wheel bridge, and the like) of an analog timepiece. The main plate or bridges are typically ones which rotatably support the first date indicator and second date indicator, and pivotably support the drive cam lever. However, the stationary support may be a timepiece part, or a portion of a timepiece, which is called by a name differing from the main plate or bridge, for example, one attached strongly to the stationary support, provided that it is stationarily placed with a strength such that it can limit the pivoting of the drive cam lever. (It may be one called by another name.)

With the calendar mechanism of the invention, typically, the one portion of the drive cam lever locked by the positioning/locking portion is one portion of the operating lever portion.

In this case, as it is sufficient that a locking is carried out between the operating lever portion, which is pivoted in a wide range of a region close to the central portion of the timepiece, and the stationary support, which can extend in the wide range of the region close to the central portion of the timepiece, a degree of freedom in design or place selection is high. However, a portion, that is, the one portion, of the drive cam lever which is locked by the positioning/locking portion may be a portion other than the operating lever portion.

With the calendar mechanism of the invention, typically, the one portion of the operating lever portion is a sidewall of the first fan-shaped gear portion the operating lever portion.

In this case, as the sidewall of the first fan-shaped gear portion at the leading end portion of the operating lever portion is also comparatively widely scanned in accordance with a pivotal scanning of the operating lever portion in the region close to the central portion of the timepiece, a positioning is easy to reliably carry out. However, the one portion of the operating lever portion may be another portion of the operating lever portion, or may be, for example, a sidewall of a portion other than the fan-shaped gear portion.

With the calendar mechanism of the invention, typically, the first and second central axes of rotation are formed of the same central axis of rotation, and the mechanism includes a rotation limit mechanism which exerts an elastic bias force which biases the second date indicator in one direction around the same central axis of rotation, wherein the elastic bias force provides a spring load on the drive cam lever.

In this case, the spring itself which provides a spring load to the drive cam lever has a function of minimizing a deviation in position of the second date indicator. The first date indicator can be positioned by a date jumper which carries out a jump control operation on the gear portion of the first date indicator.

With the calendar mechanism of the invention, typically, the rotation limit mechanism includes a rotation limit lever which, as well as including a spring torque receiving portion, is engaged integrally with the drive cam lever, and elastic means which imparts a one-direction torque to the spring torque receiving portion of the rotation limit lever.

In this case, the second date indicator can be accurately positioned via the rotation limit lever by the elastic means. However, an arrangement may be such that the elastic means, in place of exerting a deflection force directly on the second date indicator via the rotation limit lever, exerts a deflection force on the second date indicator via the drive cam lever from the rotation limit lever. Herein, the elastic means is typically formed of a leaf spring mounted on the main plate. However, it may be another spring or the like.

With the calendar mechanism of the invention, typically, the rotation limit lever includes another fan-shaped gear portion which meshes with the second fan-shaped gear portion.

In this case, the elastic means exerts a deflection force directly on the second date indicator via the rotation limit lever.

With the calendar mechanism of the invention, typically, the other fan-shaped gear portion is a fan-shaped gear portion of a shape coinciding with that of the first fan-shaped gear portion.

In this case, the other fan-shaped gear portion operates in mesh with the second fan-shaped gear portion in the condition in which it is superimposed on the first fan-shaped gear portion of the drive cam lever. However, in a case in which the rotation limit lever is built into the drive cam lever so that it can be displaced relative thereto, the other fan-shaped gear portion may be in mesh with the second fan-shaped gear portion in a portion (a circumferential portion of the arc) separate from a portion (a circumferential portion of the arc) in which the second fan-shaped gear portion is in mesh with the first fan-shaped gear portion.

An analog timepiece includes the heretofore described kind of calendar mechanism.

In this case, as the assembly of the calendar mechanism is easy, an assembly of the analog timepiece equipped with the calendar mechanism is easy. The analog timepiece may be an electronic timepiece, or may be a mechanical timepiece.

DETAILED DESCRIPTION OF THE PREFERRED EMBODIMENTS

One preferred embodiment of the invention will be described based on one preferred embodiment shown in the attached drawings.

Figure 3:
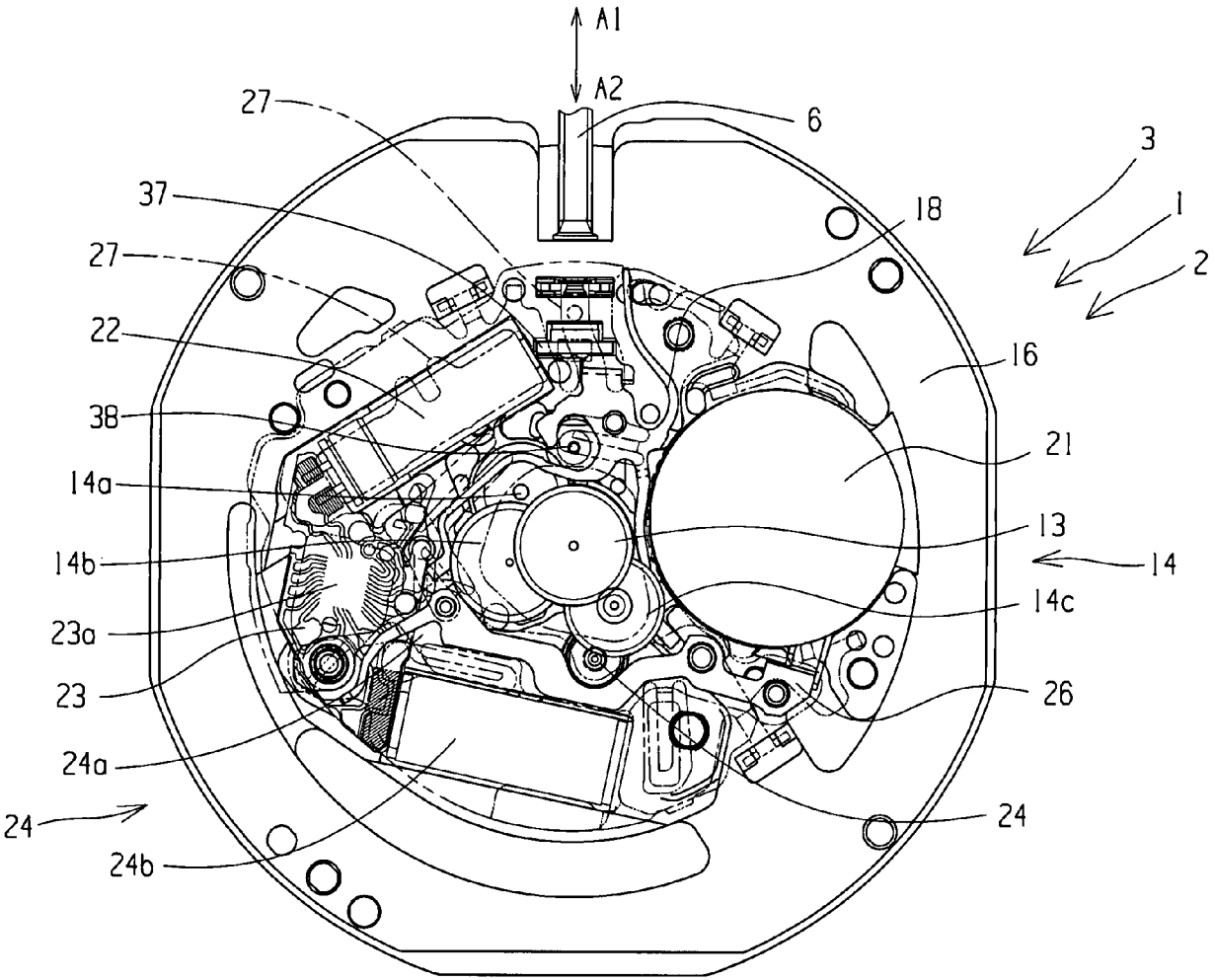
FIG. 3 is a back illustration of the main body portion of the analog timepiece of FIG. 1 seen from a back case side.
Figure 4:
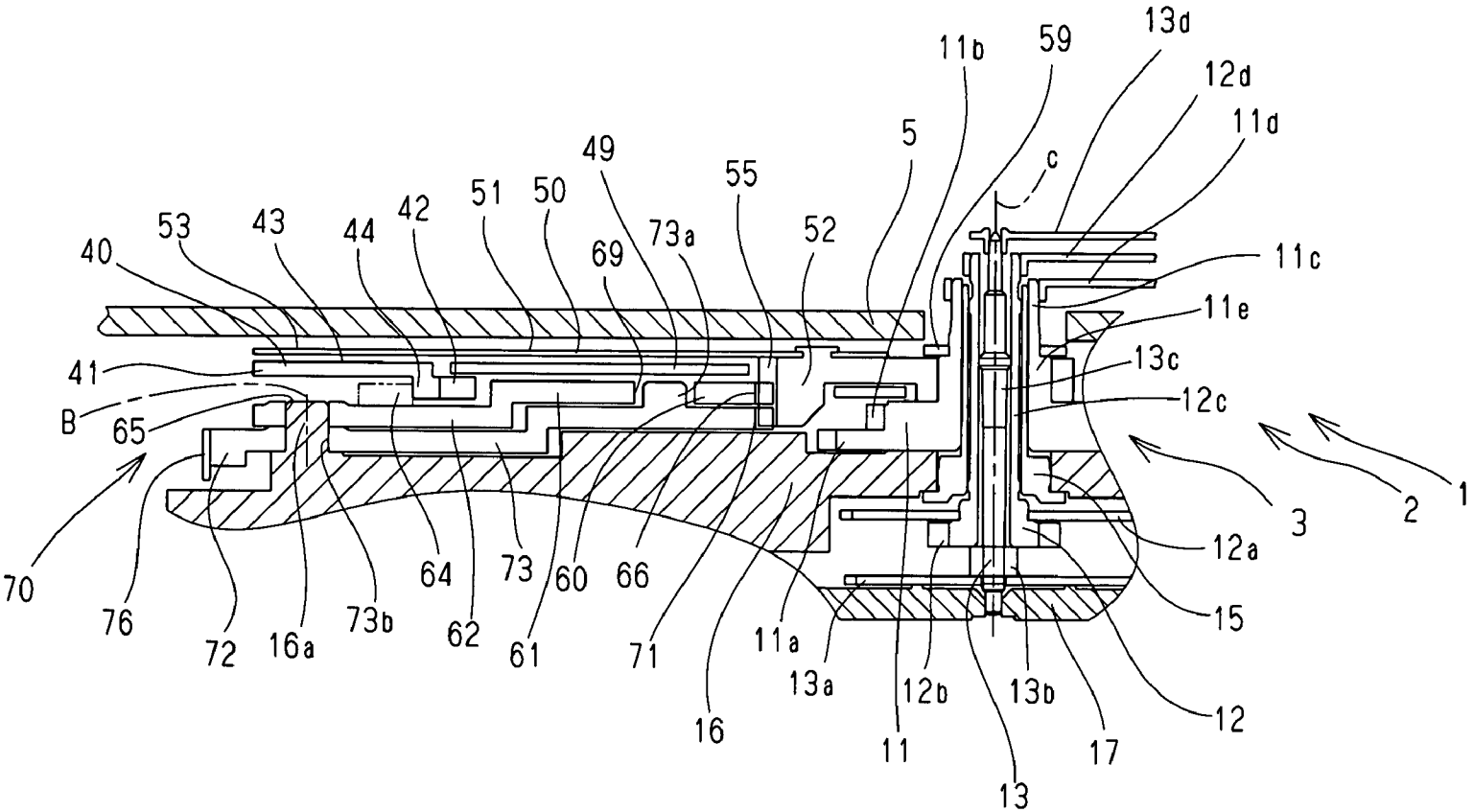
FIG. 4 is a sectional illustration showing one portion of hands and the calendar mechanism in the main body portion of the analog timepiece of FIG. 1.
Figure 5:
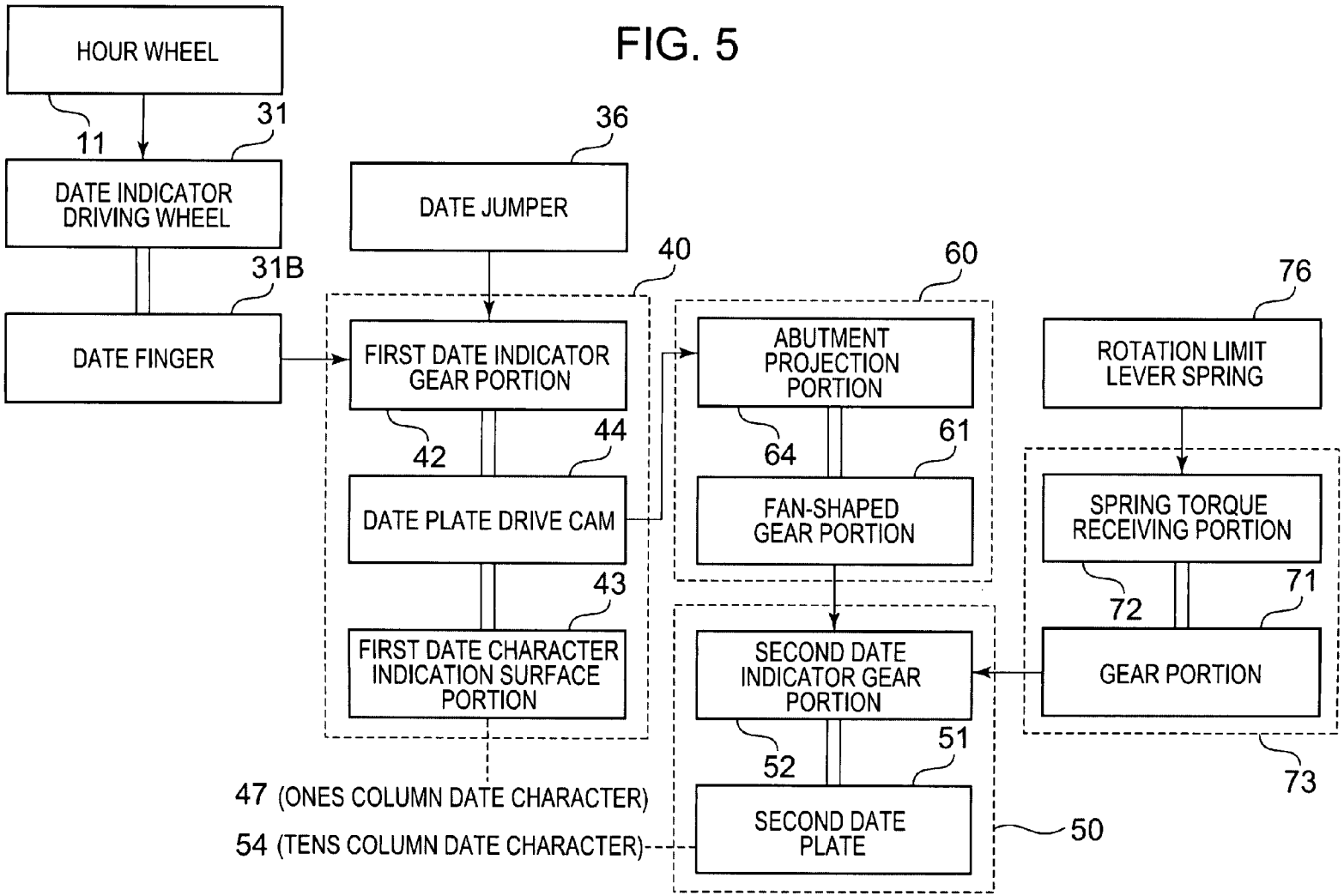
FIG. 5 is a block diagram showing an outline relationship between train wheels and the calendar mechanism of the analog timepiece of FIG. 1.

An analog timepiece 2 of one preferred embodiment of the invention including a calendar mechanism 1 of one preferred embodiment of the invention has a timepiece main body or movement 3 with substantially the kind of configuration shown in FIGS. 3 and 4. An outline relationship between train wheels and the calendar mechanism 1 of the analog timepiece 2 is shown in FIG. 5.

Figure 2:
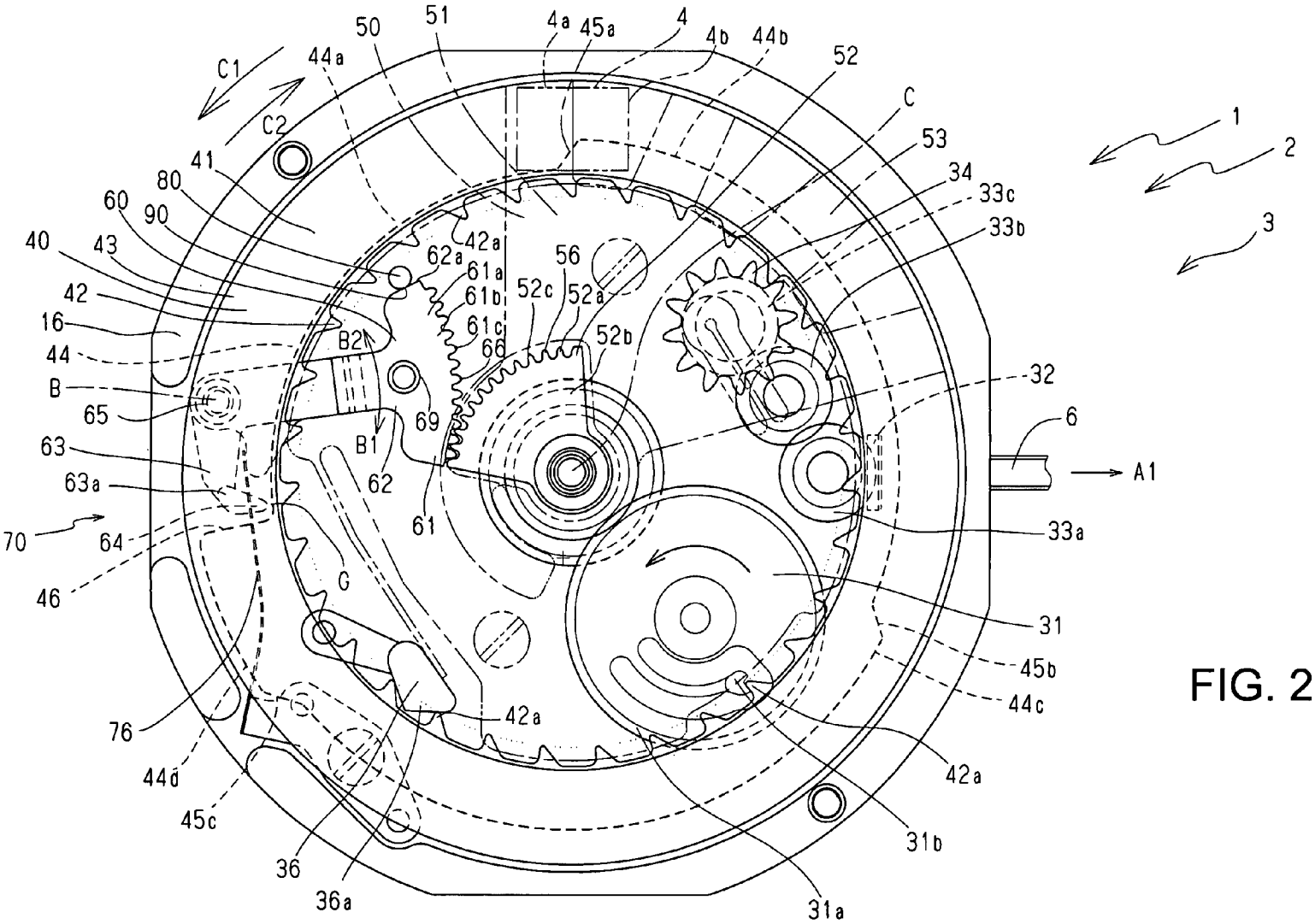
FIG. 2 is a plan illustration of a calendar mechanism of the analog timepiece of FIG. 1 seen from the dial side.
Figure 6:
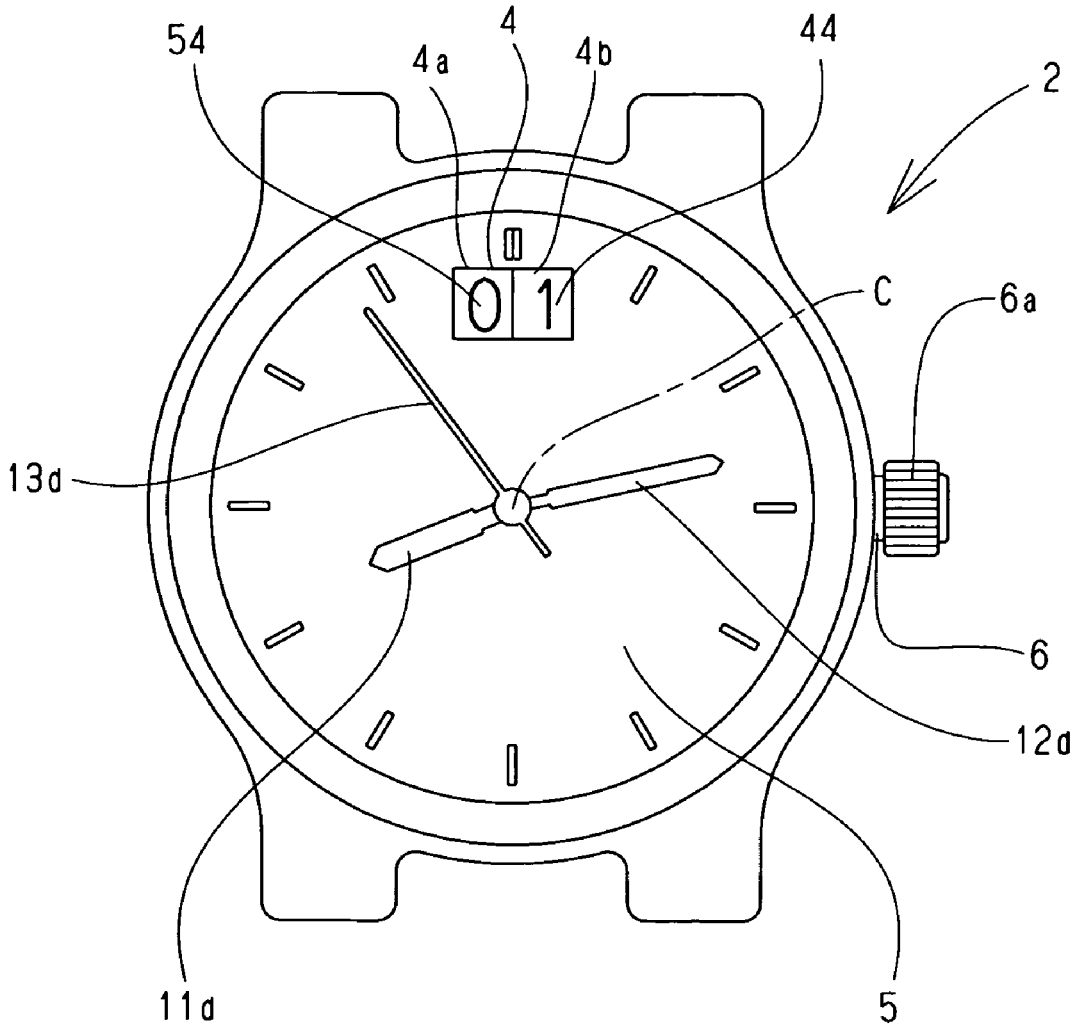
FIG. 6 is a plan illustration showing an exterior seen from the dial side of the analog timepiece of FIG. 1.

The movement 3 of the analog timepiece 2 mainly includes an hour wheel 11, a center wheel & pinion 12, and a second wheel 13 which are rotatable around a central axis C, as can be seen from FIG. 4. In FIG. 6 showing an exterior, a setting stem 6 is slightly visible on a crown 6*a*. Gears 11*a*, 11*b*, 12*a*, 12*b*, 13*a*, and 13*b* of the hour wheel 11, center wheel & pinion 12, and second wheel 13 are mutually meshed via train wheels 14, like a minute wheel 14*a*, a third wheel & pinion 14*b*, and a fifth wheel & pinion 14*c*, shown in FIG. 3. An hour hand 11*d* is mounted on a dial 5 side leading end portion of a cannon 11*c* of the hour wheel 11, a minute hand 12*d* is mounted on the leading end of a cannon 12*c* of the center wheel & pinion 12, and a second hand 13*d* is mounted on the leading end portion of an axle or spindle 13*c* of the second wheel 13. A minute gear 12*a* configuring the center wheel & pinion 12 is in slippable engagement with a minute pinion 12*b* integral with the cannon 12*c*. 15 is a central pipe. Herein, 16 is a main plate forming the substrate of the movement 3, and 17 is a train wheel bridge. The gears 12*a* and 12*b* of the center wheel & pinion 12 and the gears 13*a* and 13*b* of the second wheel 13 are disposed between the main plate 16 and train wheel bridge 17, and the gears 11*a* and 11*b* of the hour wheel 11 are disposed on the dial 5 side of the main plate 16. The small gear 11*b* of the hour wheel 11 forms a date indicator advancing gear meshing with a date indicator driving gear 31*a* of a date indicator driving wheel 31 (FIG. 2) as a date indicator driving pinion. In FIG. 3, 18 is a train wheel setting lever pivoted in response to a pulling out and pushing in of a setting stem 6 in A1 and A2 directions.

In a case of the kind of electronic timepiece, that is, quartz timepiece shown in FIG. 3, the analog timepiece 2 includes a circuit block 23 including a crystal oscillator, which is fed with power from a battery 21 to perform an oscillation operation, or a crystal oscillator capsule 22 including this, and a motor 24 which rotates the hands 11*d*, 12*d*, and 13*d* via the train wheels 14 and the like. The motor 24 includes a stator 24*a*, a coil block 24*b*, and a rotor 24*c*. 26 is a battery connection (−), and 27 is a circuit maintaining plate.

The calendar mechanism 1 of the analog timepiece 2 includes a first date indicator 40, a second date indicator 50, a drive cam lever 60, and a rotation limit mechanism 70.

The first date indicator 40 includes a circular body 41 disposed so as to be rotatable around the central axis C acting as a first central axis of rotation, a first data indicator gear portion 42 connected to the inner peripheral edge of the circular body 41 via a stepped portion in a position shifted in a direction of thickness of the circular body 41, a first date character indication surface portion 43 formed of a dial 5 side main surface portion of the circular body 41, and a drive cam portion 44 which is formed along the outer peripheral surface of a stepped portion on a main surface side of the circular body 41 facing a case back and between the inner peripheral edge of the circular body 41 and the first date indicator gear portion 42.

The first date indicator gear portion 42 has 31 teeth 42*a* facing in one direction in such a way as to be rotated around the central axis C in one direction (counterclockwise as seen from the dial 5 side) C1. The C1 direction rotation of the first date indicator 40 is limited by a date indicator jumper 36 including a jump control pawl portion 36*a* which performs a jump control operation between adjacent teeth 42*a* and 42*a* of the first date indicator gear portion 42.

The drive cam portion 44 includes a first cam arc portion 44*a* acting as an invalid cam face portion following an arc with the smallest radius from a center C, a second cam arc portion 44*b* acting as a second cam face portion following an arc with the second smallest radius from the center C, a third cam arc portion 44*c* acting as a third cam face portion following an arc with the third smallest radius from the center C, and a fourth cam arc portion 44*d* acting as a fourth cam face portion following an arc with the largest radius from the center C. The arc portions 44*a*, 44*b*, 44*c*, and 44*d* extend along the angle ranges of sizes of substantially around 9/31, 10/31, 10/31, and 2/31 of the whole circumference respectively, and their regions are connected via inclined transition regions 45*a*, 45*b*, and 45*c*. A boundary surface or stepped surface 46 extending in a substantially radial direction is formed between the fourth cam arc portion 44*d* and first cam arc portion 44*a*.

A reference position determination projection 80 acting as a positioning/locking portion or stopper which functions as a real first cam face portion is provided projecting from the main plate 16. The projection 80 may be formed integrally in a projecting condition as one portion of the main plate 16 acting as a stationary support, or may be a pin planted in the main body portion of the main plate 16. In this example, the first cam arc portion 44*a* forms the invalid cam face portion.

The reference position determination projection 80 may be formed on the train wheel bridge 17 or other bridge in place of the main plate 16, or may be formed on a stationary support, such as the main plate 16 or train wheel bridge 17, or on another portion essentially fixed with respect to the stationary support.

During a normal hand movement, the first date indicator 40 is engaged with a date finger 31*b* of the date indicator driving wheel 31, which is rotated in accordance with a rotation of the hour wheel 11, by means of a tooth 42*a* of the first date indicator gear portion 42, and rotated 360/31 degrees in the C1 direction once a day. At a time of a date correction, the setting stem 6 is pulled out in the A1 direction, and a rotation of the setting stem 6 is transmitted to the first date indicator gear portion 42 of the first date indicator 40 via a clutch wheel 37 and a setting wheel 38, and furthermore, via a first date corrector setting intermediate wheel or first calendar corrector setting wheel 32, a second date corrector setting intermediate wheel 33*a*, a third date corrector setting intermediate wheel 33*b*, a fourth date corrector setting intermediate wheel 33*c*, and a date corrector setting wheel 34, and the first indicator gear portion 42 is rotated in the C1 direction in accordance with the rotation of the setting stem 6, thus carrying out the date correction.

Figure 1:
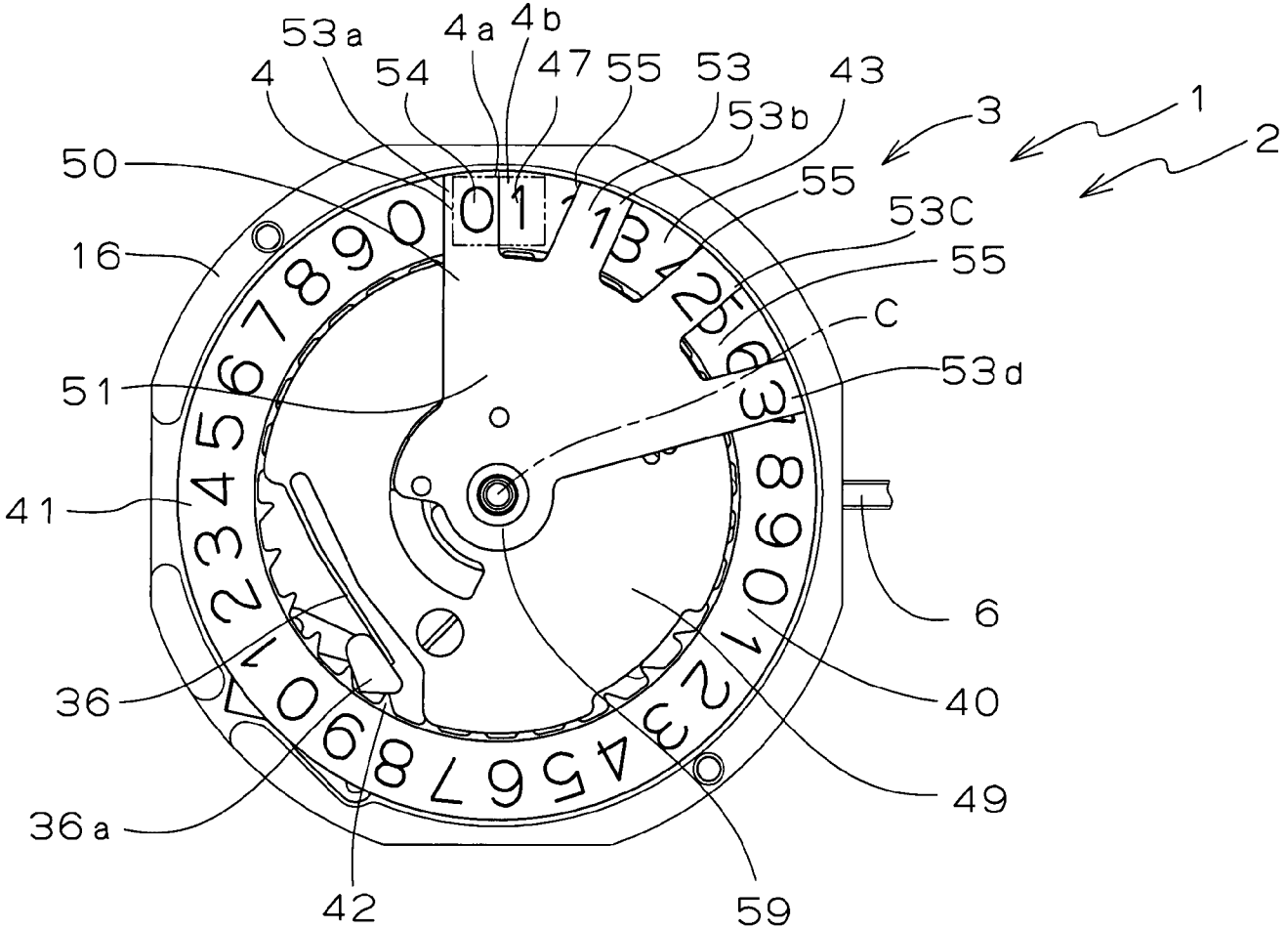
FIG. 1 is a plan illustration of a main body portion of an analog timepiece of one preferred embodiment of the invention including a calendar mechanism of one preferred embodiment of the invention, seen from a dial side.

On the first date character indication surface portion 43 acting as a first date character indication portion of the first date indicator 40, as characters forming first date characters 47, "1" is added after a string of ten characters "1, 2, 3, 4, 5, 6, 7, 8, 9, and 0" is repeated three times, and a total of 31 characters 47 are placed at regular intervals in the circumferential direction. The first date characters 47 of the first date character indication surface portion 43 indicate the ones column of the date within a right side region 4*b* of a date window 4 of the dial 5, as can be seen from FIGS. 6 and 1, when the characters 47 reach the vicinity of the 12:00 position of the timepiece 2.

The first date indicator gear portion 42 of the first date indicator 40 is positioned on a side closer to the case back than to the first date character indication surface portion 43. The first date indicator 40 is lightly pressed in the substantially circular first date indicator gear portion 42 by a first date indicator cover 49 mounted on the main plate 16.

The second date indicator 50 includes a substantially fan-shaped large diameter plate-like body or second date plate 51 disposed so as to be rotatable around the central axis C acting as a second central axis of rotation, a date indication wheel or second date indicator gear portion 52 as a second fan-shaped gear portion or operated gear portion which, supporting the second date plate 51 in the vicinity of the central axis C, includes small fan-shaped teeth 56 which project somewhat beyond one side of the second date plate 51, and a second date character indication surface portion 53 is formed in the vicinity of the outer peripheral edge of the second date plate 51. Herein, the first and second central axes of rotation are formed of the same central axis C.

The second date character indication surface portion 53 acting as a second date character indication portion has four substantially trapezoidal indication surface portions 53*a*, 53*b*, 53*c*, and 53*d* projecting via circumferential gaps 55, and characters "0, 1, 2, and 3" are put on the second date character indication surface portions 53*a*, 53*b*, 53*c*, and 53*d*, respectively, as second date characters 54. The second date characters 54 of the second date character indication surface portion 53 indicate the tens column of the date within a left side region 4*a* of the date window 4 of the dial 5, as can be seen from FIGS. 6 and 1, when the characters 54 reach the vicinity of the 12:00 position of the timepiece 2.

The second date indicator gear portion 52, being of a form of a fan-shaped gear 52*a* rotatably fitted around a large diameter cannon portion 11*e* of the hour wheel 11, includes a plurality of the teeth 56 on an arc-shaped portion 52*c* of a fan 52*b*.

During the normal hand movement, the second date indicator 50 is pivoted in the C1 direction by receiving a counterclockwise rotation drive in the second date indicator gear portion 52 every time the tens column of the date changes from 0 to 1, from 1 to 2, or from 2 to 3, and pivoted in a C2 direction by receiving a clockwise rotation drive in the second date indicator gear portion 52 when the tens column of the date changes from 3 to 0, thus indicating the tens column of the date.

The second date indicator gear portion 52 of the second date indicator 50 is lightly pressed by a second indicator cover 59 fitted in the cannon 11*c* of the hour wheel 11 at the back of the dial 5.

The drive cam lever 60 integrally includes an operating lever portion 62 including a fan-shaped gear portion 61, and a driven lever portion 63 which, extending in a direction substantially perpendicular to the operating lever portion 62, includes an abutment projection portion 64 forming a cam follower in one side portion 63*a* of an extending end portion, and the drive cam lever 60 is mounted on a projection portion 16*a* of the main plate 16, in a hole portion 65 of the connection of the two lever portions 62 and 63, so as to be rotatable in B1 and B2 directions around a central axis B. The operating lever portion 62 includes a hole portion 69 in the fan-shaped gear portion 61.

The abutment projection portion 64 at the leading end of the driven lever portion 63 of the drive cam lever 60, as the cam follower, being in abutment with cam face portions 44*b*, 44*c*, and 44*d* of the drive cam portion 44 of the first date indicator 40, is pivoted in the B1 and B2 directions around the central axis B in accordance with a radial change of position (distance from the central axis C) of the cam face portions 44*b*, 44*c*, and 44*d* to be abutted against.

The drive cam lever 60 includes an abutment portion 90 forming a second cam follower on a side surface 62*a* of the fan-shaped gear portion 61 of the operating lever portion 62.

Consequently, when the abutment projection portion 64 at the leading end of the driven lever portion 63 of the drive cam lever 60 is in a condition in which the first date indicator 40 is rotated in such a way that the abutment projection portion 64 faces the cam face portion 44*a*, among the cam face portions of the drive cam portion 44 of the first date indicator 40, which forms the invalid cam face portion, while a gap G (FIG. 2) remains between the abutment projection portion 64 at the leading end of the driven lever portion 63 of the drive cam lever 60 and the cam face portion 44*a* of the drive cam portion 44 of the first date indicator 40, the abutment portion 90 acting as the second cam follower on the side surface 62*a* of the fan-shaped gear portion 61 of the operating lever portion 62 of the drive cam lever 60 abuts against the reference position determination projection 80, thus determining a B2 direction pivotal position of the drive cam lever 60.

On the drive cam lever 60 being pivoted in the B1 and B2 directions, the fan-shaped gear portion 61 of the operating lever portion 62 of the drive cam lever 60 is also pivoted in the B1 and B2 directions.

The fan-shaped gear portion 61, being of a form of a substantially fan-shaped gear 61*a*, includes teeth 66 on an arc-shaped portion 61*c* of a fan 61*b*.

The fan-shaped gear portion 61 of the drive cam lever 60 meshes with the second date indicator gear portion 52 of the second date indicator 50.

The rotation limit mechanism 70, being a mechanism which exerts a B2 direction bias force on the drive cam lever 60, in this example, includes a rotation limit lever 73 including a gear portion 71 meshing with the gear portion 52 of the second date indicator 50 and a torque receiving portion 72, and a leaf spring 76 as elastic means which exerts a B2 direction pivotal bias force on the rotation limit lever 73.

The rotation limit lever 73 further includes a projection portion 73*a* and a hole portion 73*b*. The rotation limit lever 73, in a condition in which it is fitted in the hole portion 69 of the operating lever portion 62 of the drive cam lever 60 by means of the projection portion 73*a*, is fitted around the projection portion 16*a* of the main plate 16, together with the operating lever portion 62 of the drive cam lever 60, by means of the hole portions 65 and 73*b*. Consequently, the rotation limit lever 73 is pivotable around the projection portion 16*a* of the main plate 16 integrally with the drive cam lever 60.

That is, the rotation limit mechanism 70 exerts the B2 direction bias force on the drive cam lever 60, and thereby exerts a C2 direction bias force on the second date indicator gear portion 52 of the second date indicator 50, thus preventing a rotational position of the second date indicator 50 from varying due to a slight backlash unavoidable in putting gears in mesh, and the second date characters from deviating from a desired indication position.

In this example, the gear portion 71 of the rotation limit lever 73, having teeth of a shape in actuality identical to that of those of the fan-shaped gear portion 61 of the drive cam lever 60 in a condition in which they are exactly aligned with each other in an extending direction of the central axis C, are in mesh with the second date indicator gear portion 52.

The leaf spring 76 of the rotation limit mechanism 70 applies a B2 direction torque to the torque receiving portion 72 of the rotation limit lever 73, thereby exerting the C2 direction bias force on the second date indicator 50 meshing with the gear portion 71 of the rotation limit lever 73 by means of the second date indicator gear portion 52.

Also, as the second date indicator gear portion 52 of the second date indicator 50 is biased in the C2 direction, the drive cam lever 60 meshing therewith by means of the fan-shaped gear portion 61 is also biased in the B2 direction, and the driven lever portion 63 of the drive cam lever 60 is pressed against the cam face portions 44*b*, 44*c*, and 44*d* of the drive cam portion 44 by the abutment projection portion 64 at the leading end, or the abutment portion 90 acting as the second cam follower on the side surface 62*a* of the fan-shaped gear portion 61 of the operating lever portion 62 of the drive cam lever 60 abuts against the reference position determination projection 80 (at this time, the abutment projection portion 64 at the leading end of the driven lever portion 63 faces the invalid cam face portion 44*a* of the drive cam portion 44 across the gap G), thereby enabling a positioning without a backlash.

In this example, as the rotation limit lever 73 is arranged in such a way as to not only be pivotable concentric with the drive cam lever 60 by means of the axle-shaped projection portion 16*a*, but also to be fitted in the hole of the drive cam lever 60 by means of the projection portion 74 and move in actuality integrally with the drive cam lever 60, it may be considered that an arrangement is such that the B2 direction pivotal bias force of the leaf spring 76 is applied to the drive cam lever 60 directly from the rotation limit lever 73.

With the analog timepiece 2 configured in the way heretofore described, when assembling the calendar mechanism 1, after building basic timepiece train wheels relating to the operation of the hands 11*d*, 12*d*, and 13*d* of the timepiece 2 mainly into the case back side of the main plate 16, as well as the date indicator driving wheel 31, the train wheels 33*a*, 33*b*, 33*c*, and 34 relating to the date correction, and the like, being built into the main plate 16, the leaf spring 76 and the like of the limit mechanism 70 are built thereinto, in a condition in which the main plate 16 is turned upside down as in the condition of FIG. 4 so that a side on which the dial 5 is disposed faces upward.

Next, a combination 60 and 73 of the drive cam lever 60 and rotation limit lever 73 is disposed in such a way that the hole portions 65 and 73*b* are fitted around the projection portion 16*a* of the main plate 16, and in such a way that a spring force of the leaf spring 76 in the B2 direction acts on the spring torque receiving portion 72 of the rotation limit lever 73.

At this time, the combination body of the drive cam lever 60 and rotation limit lever 73 is biased in the B2 direction by the spring force of the leaf spring 76, and the operating lever 62 of the drive cam lever 60 is maintained in a condition in which the abutment portion 90 on the side surface 62*a* is in abutment with the reference position determination projection 80 of the main plate 16.

Subsequently, the first date indicator 40 is disposed in a condition in which the first date indicator 40 is adjusted to a kind of rotational position in which the first cam arc portion or first cam face portion 44*a* acting as the invalid cam face portion of the drive cam portion 44 faces the abutment projection portion 64 of the driven lever portion 63 of the drive cam lever 60 across the gap G. Next, after the date corrector setting wheel 34 has been brought into meshing engagement with the first date indicator gear portion 42, the first date indicator cover 49 is mounted thereon.

With the analog timepiece 2, unlike the case of a heretofore known assembly of this kind of timepiece, when the first date indicator 40 is mounted in this way, there is no need to mount the first date indicator 40 while shifting the position of the drive cam lever 60 hidden behind, meaning that a building in of the first date indicator 40 can be extremely easily and reliably carried out in a short time.

That is, with the calendar mechanism 1 of the analog timepiece 2, as "the cam face of the drive cam portion 44, as well as including the fourth cam face portion 44*d* corresponding to a case in which the tens column of the date is 3, includes the invalid cam face portion 44*a* corresponding to a case in which the tens column of the date is 0, and the reference position determination projection 80 is provided which, projecting from the main plate 16 of the mechanism 1, functions as the first cam face portion, wherein the mechanism 1 is configured in such a way that, in the case in which the tens column of the date is 0, the one side abutment portion 90 of the drive cam lever 60 abuts against the reference position determination projection 80, causing the cam follower 64 of the driven lever portion 63 to come near to and face the invalid cam face portion 44*a*, among the cam face portions 44*a*, 44*b*, 44*c*, and 44*d* of the drive cam portion 44, but to remain in a condition out of contact with the invalid cam face portion 44*a*", in an initial building-in condition in which the one side abutment portion 90 of the drive cam lever 60 is brought into abutment with the reference position determination projection 80, the invalid cam face portion 44*a*, among the cam face portions 44*a*, 44*b*, 44*c*, and 44*d* of the first date indicator 40, does not abut against the drive cam lever 60, meaning that when an arrangement is adopted such that the first date indicator 40 is built in a predetermined rotational position (a kind of rotational position in which the cam follower 64 of the driven lever portion 63 of the drive cam lever 60 faces the invalid cam face portion 44*a*, among the cam face portions 44*a*, 44*b*, 44*c*, and 44*d* of the first date indicator 40, in the out-of-contact condition across the gap G) with the drive cam lever 60 remaining placed in the initial building-in condition, it is possible, without taking into account an engagement with the drive cam lever 60, to build in the first date indicator 40 simply by mounting the first date indicator 40 in the predetermined rotational position (rotational range), in actuality in the condition out of contact with the drive cam lever 60, that is, without shifting (pivoting) the drive cam lever 60. Consequently, as the building in of the first date indicator 40 does not take a lot of trouble, the building-in property of the first date indicator 40 is improved, and a building in of the calendar mechanism 1 can be easily carried out.

Next, the second date indicator 50 is disposed in such a way that the fan-shaped gear portion 52*a* thereof is fitted around the cannon portion 11*e* of the hour wheel 11, and the teeth 56 of the second date indicator gear portion 52 thereof mesh with the teeth 66 of the fan-shaped gear portion 61 of the operating lever portion 62 of the drive cam lever 60.

Heretofore, a description has been given of an example in which the drive cam lever 60 and rotation limit lever 73 are formed in actuality integrally, and the spring load of the leaf spring 76 is applied to the rotation limit lever 73, but an arrangement may be such that the rotation limit lever 73 is omitted, and the spring load of the leaf spring 76 is directly applied to the drive cam lever 60. That is, for example, a torque receiving portion corresponding to the torque receiving portion 72 being formed on the drive cam lever 60, the B2 direction bias force may be directly applied to the torque receiving portion of the drive cam lever 60 by elastic means such as the leaf spring 76. Also, in place of the rotation limit lever 73 being formed in a condition in which it is superimposed on the drive cam lever 60, an arrangement may be such that the rotation limit lever 73 is provided in a position differing from that of the drive cam lever 60 in the C1 or C2 direction, and a bias force which tends to rotate the second date indicator gear portion 52 of the second date indicator 50 in the C2 direction is applied to the torque receiving portion 72 of the rotation limit lever 73 by elastic means similar to the leaf spring 76.

Furthermore, when desired, an arrangement may be such that the rotation limit lever 73 is omitted, a spring load caused by a spring such as the leaf spring 76 is applied to the second date indicator 50, and the spring load is indirectly applied to the drive cam lever 60 meshing with the gear portion 52 of the second date indicator 50 by means of the gear portion 61.

What is claimed is:

1. A calendar mechanism, comprising:

a first date indicator which, being rotatable around a first central axis of rotation, includes a first date character indication portion which, being circular as a whole, indicates the ones column of the date, a circular first date indicator gear portion which, being formed on the inner periphery of the first date character indication portion, receives a torque, and a drive cam portion which, being formed on the back side of a first date character indication surface portion, defines an endless ring-shaped cam face;

a drive cam lever which includes a driven lever portion whose one end portion abuts against the drive cam portion as a cam follower, and an operating lever portion which, being integral with the driven lever portion, includes a first fan-shaped gear portion at the leading end portion, wherein the one end portion of the driven lever portion is spring loaded in such a way as to be biased toward the cam face of the drive cam portion, and when the driven lever portion is pivoted in a condition in which the one end portion is in abutment with the cam face of the drive cam portion, the first fan-shaped gear portion of the operating lever portion is pivoted in accordance with the pivoting of the driven lever portion;

a second date indicator which, being rotatable around a second central axis of rotation, includes a second date character indication portion which indicates the tens column of the date, and a second fan-shaped gear portion meshing with the first fan-shaped gear portion; and a stationary support including a positioning/locking portion, wherein the cam face of the drive cam portion, as well as including a second and third cam face portion corresponding to a case in which the tens column of the date is 1 and 2, and including a fourth cam face portion corresponding to a case in which the tens column of the date is one of 0 or 3, includes an invalid cam face portion corresponding to a case in which the tens column of the date is the other of 0 or 3, wherein the calendar mechanism is configured in such a way that in the case in which the tens column of the date is the other of 0 or 3, one portion of the drive cam lever abuts against the positioning/locking portion, causing the cam follower of the driven lever portion to come near to and face the invalid cam face portion of the cam face of the drive cam portion, but to remain in a condition out of contact with the invalid cam face portion.

2. A calendar mechanism according to claim 1, wherein the invalid cam face portion is a portion of the cam face corresponding to a case in which the tens column of the date is 0, and the fourth cam face portion is a portion of the cam face corresponding to a case in which the tens column of the date is 3.

3. A calendar mechanism according to claim 1, wherein the positioning/locking portion is formed of a reference position determination projection formed on the stationary support.

4. A calendar mechanism according to claim 2, wherein the positioning/locking portion is formed of a reference position determination projection formed on the stationary support.

5. A calendar mechanism according to claim 1, wherein the stationary support is formed of a main plate or a bridge.

6. A calendar mechanism according to claim 2, wherein the stationary support is formed of a main plate or a bridge.

7. A calendar mechanism according to claim 3, wherein the stationary support is formed of a main plate or a bridge.

8. A calendar mechanism according to claim 4, wherein the stationary support is formed of a main plate or a bridge.

9. A calendar mechanism according to claim 1, wherein the one portion of the drive cam lever locked by the positioning/locking portion is one portion of the operating lever portion.

10. A calendar mechanism according to claim 2, wherein the one portion of the drive cam lever locked by the positioning/locking portion is one portion of the operating lever portion.

11. A calendar mechanism according to claim 3, wherein the one portion of the drive cam lever locked by the positioning/locking portion is one portion of the operating lever portion.

12. A calendar mechanism according to claim 4, wherein the one portion of the drive cam lever locked by the positioning/locking portion is one portion of the operating lever portion.

13. A calendar mechanism according to claim 5, wherein the one portion of the drive cam lever locked by the positioning/locking portion is one portion of the operating lever portion.

14. A calendar mechanism according to claim 6, wherein the one portion of the drive cam lever locked by the positioning/locking portion is one portion of the operating lever portion.

15. A calendar mechanism according to claim 7, wherein the one portion of the drive cam lever locked by the positioning/locking portion is one portion of the operating lever portion.

16. A calendar mechanism according to claim 9, wherein the one portion of the operating lever portion is a sidewall of the first fan-shaped gear portion of the operating lever portion.

17. A calendar mechanism according to claim 1, wherein the first and second central axes of rotation are formed of the same central axis of rotation, the mechanism comprising:

a rotation limit mechanism which exerts an elastic bias force which biases the second date indicator in one direction around the same central axis of rotation, wherein the elastic bias force provides a spring load on the drive cam lever.

18. A calendar mechanism according to claim 17, wherein the rotation limit mechanism includes a rotation limit lever which, as well as including a spring torque receiving portion, is engaged integrally with the drive cam lever, and elastic means which imparts a one-direction torque to the spring torque receiving portion of the rotation limit lever.

19. A calendar mechanism according to claim 18, wherein the rotation limit lever includes another fan-shaped gear portion which meshes with the second fan-shaped gear portion.

20. An analog timepiece, comprising:

the calendar mechanism according to claim 1.

* * * * *